United States Patent [19]

Rotter

[11] 4,309,195

[45] Jan. 5, 1982

[54] APPARATUS FOR GASIFYING SOLID FUELS AND WASTES

[75] Inventor: Franz Rotter, Portland, Oreg.

[73] Assignee: Energy Recovery Research Group, Inc., Portland, Oreg.

[21] Appl. No.: 155,514

[22] Filed: Jun. 2, 1980

[51] Int. Cl.[3] ..... C10J 3/68

[52] U.S. Cl. ..... 48/76; 48/77; 48/63; 48/111

[58] Field of Search ..... 48/111, 77, 62 R, 76, 48/63, 64, 209, 73

[56] References Cited

U.S. PATENT DOCUMENTS

| | | | |
|---|---|---|---|
| 1,177,584 | 3/1916 | Wallmann | 48/63 |
| 1,821,263 | 9/1931 | Imbert | 48/76 |

FOREIGN PATENT DOCUMENTS

| | | | |
|---|---|---|---|
| 368876 | 3/1939 | Italy | 48/111 |
| 232565 | 9/1944 | Switzerland | 48/62 R |

*Primary Examiner*—S. Leon Bashore
*Assistant Examiner*—Michael L. Goldman
*Attorney, Agent, or Firm*—Philip D. Junkins

[57] ABSTRACT

Apparatus for effecting the conversion of solid fuels (including solid organic waste materials having a fuel valve) by high temperature gasification into clean-burning and uniform gaseous fuel called "producer gas." The apparatus comprises a two-section, stacked double-shell gasifier reactor defining sequentially descending, drying, distillation, oxidation and reduction reaction zones through which a continuously fed column of the solid fuel descends during its conversion to a gaseous fuel. Means are provided for drawing process air into the oxidation zone for burning reaction with carbonized fuel passing therethrough and for thereafter drawing reaction gases in downdraft fashion through the lower fuel reduction zone of the gasifier and thence in sequence through the annular space defined by the double-shell structure of the lower section of the gasifer in indirect countercurrent heat exchange relationship with the fuel column portion in the oxidation and reduction zones and through the annular space defined by the double-shell structure of the upper section of the gasifier in indirect co-current heat exchange relationship with the fuel column portion in the drying and distillation zones. The inner shell elements of the two sections of the stacked double-shell reactor structure are arranged in hanging manner within their respective outer shell elements to allow expansion of the double-shell structure under the high temperature conditions experienced by the gasifier without harmful stress build-up in the apparatus.

8 Claims, 1 Drawing Figure

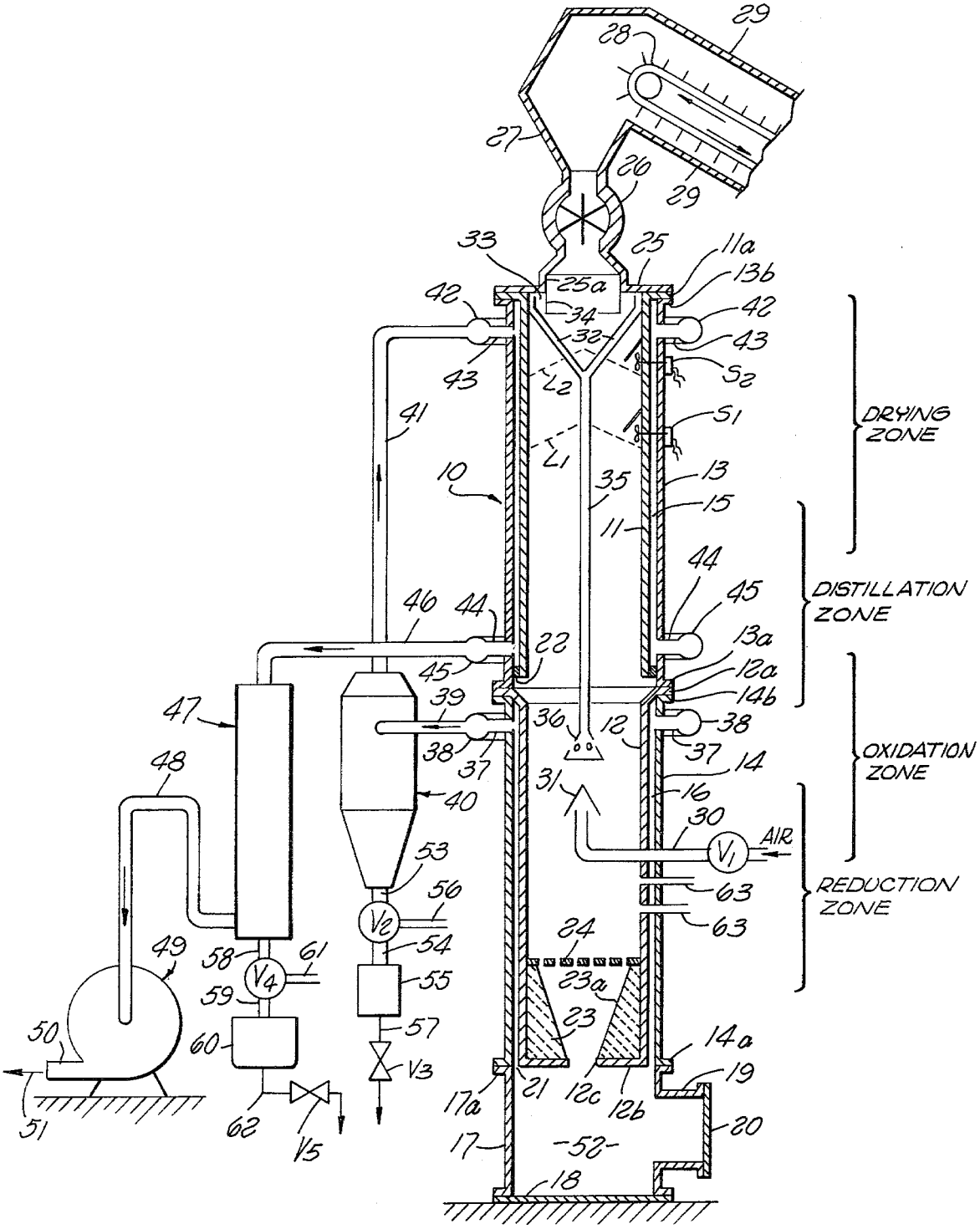
DRYING ZONE
DISTILLATION ZONE
OXIDATION ZONE
REDUCTION ZONE
AIR

APPARATUS FOR GASIFYING SOLID FUELS AND WASTES

BACKGROUND OF THE INVENTION

This invention relates to apparatus for the conversion of solid organic materials, having a fuel value, by high temperature gasification into a clean-burning and uniform gaseous fuel called "producer gas." More particularly, the invention relates to a gasifier in which peat, lignite, coal, anthracite, coke and other solid organic materials (including solid organic waste materials such as wood chips, sawdust, pine cones, other forest wastes, walnut and almond shells, fruit pits, corn cobs and other agricultural wastes, and like materials) used as solid fuels are transformed into gaseous fuels and in the process of such transformation carry the largest possible amount of energy from the solid to the gaseous state while keeping the resulting gaseous fuels clean and free from undesireable constituents of the solid fuels.

Solid fuels of the type mentioned above, in addition to containing the impurities of ash and water, consist of so-called fixed carbon and volatile matter. The objective of gasification is to obtain substantially complete transformation of the gasifiable constituents of the solid fuel into fuel gases leaving only ash and inert materials as a solid residue of the conversion process. Gasification occurs when air is led across or drawn through glowing hot gasification material, the stream of air being either dry or containing steam. Usually gasification occurs under the influence of steam since the air flow always contains some moisture and the solid fuels normally utilized in gasification systems contain moisture. Further, such solid fuels usually contain some hydrogen which reacts with oxygen creating steam.

Gasification systems and their associated gasifier apparatus have generally fallen into one of three classifications as follows: (1) updraft gasification; (2) downdraft gasification; and (3) crossdraft gasification. Under each classification a column of the solid fuel to be gasified is developed in a reactor or stack and air is passed through the column. As the fuel gasification proceeds the column gradually moves downwardly within the reactor or stack into a lower hearth zone. The air stream can be led in the same direction as the direction of fuel movement (downdraft gasification) or led in a direction opposite to the direction of movement of the descending fuel column (updraft gasification). If the air stream traverses the descending fuel column crossdraft gasification is promoted. Each method allows the fuel to gradually enter the hearth zone where highest temperature conditions subsist.

In the basic form of an updraft gasification system the fuel column rests on a grate through which a stream of air and steam passes. Above the grate a hearth zone develops with a reduction zone, a distillation zone and a drying zone lying sequentially above the hearth zone within the fuel column. The product gas is drawn off above the fuel column after having transferred some of its heat to the fuel in the distillation and drying zones in the upper part of the column. Only tar free fuels such as charcoal or anthracite are suitable for updraft gasification systems. If the fuel contains tar, as do wood, peat, lignite, etc., the tar is gasified and carried off with the producer gas generated through the gasification system. A tar separator is then required to prevent the tars from fouling or otherwise adversely affecting downstream equipment.

In downdraft gasifiers the air stream enters the system in the area of the hearth zone (usually through nozzles arranged circumferentially or through a central nozzle) and draws all of the gaseous fuel components down into the hearth zone, there to enter into the gasification reactions. Tars and moisture are exposed at high temperature to the carbon in the hearth zone and undergo partial combustion and partial dissociation so that the final producer gas leaving the system is tar free. Downdraft gasification systems have developed a characteristic funnel shaped constriction of the hearth at or just below the entry of the air stream. The hearth constriction or throat causes a localized increase in the air flow velocity which in turn causes localized high temperature conditions for conversion of the tars into their gaseous components. Downdraft gasifier operation is generally unsuitable for fuels with high ash content because the high temperatures generated in the throat section of the hearth cause sintering of the ash into a slag which is difficult to remove and causes functional problems in the system.

In crossdraft gasification air is introduced through a small diameter high velocity nozzle and is projected across the fuel column to achieve a hearth zone of small volume but of very high temperature. Tar dissociation is limited because of the small hearth zone that is developed and therefore low tar fuels are preferred for crossdraft gasification.

OBJECTS OF THE INVENTION

The present invention relates to high temperature gasification apparatus involving the basic characteristics of downdraft gasification systems. Accordingly, an object of the present invention is to provide novel gasifier apparatus for converting solid organic materials (having a fuel value) by high temperature downdraft gasification into a cleanburning and uniform gaseous fuel called "producer gas," the gasifier being of double-shell construction with the inner shell being of suspended design to allow expansion of the gasifier shell elements without stress build-up in the apparatus.

Another object of the present invention is to provide gasifier apparatus for high temperature gasification of solid organic materials (having a fuel value) which is of dual-stacked, double-shell construction with the inner shell of each stacked gasifier section being of suspended design to allow expansion of the gasifier shell elements without stress build-up and with the inner and outer shells of each stacked section defining an annular space for the passage therethrough of "producer gas" (generated within the gasifier) in indirect heat exchange relationship with materials undergoing gasification.

A still further object of the invention is to provide gasifier apparatus of dual-stacked, double-shell configuration in which downdraft gasification (conducted at relatively high gasification temperature) may be carried on without stress build-up in the apparatus because of heat expansion of the gasifier shell elements, and in which the "producer gas" (generated within the gasifier) moves in countercurrent indirect heat exchange relationship with materials undergoing gasification within the lower gasifier section and in co-current indirect heat exchange relationship with such materials within the upper gasifier section.

Still other objects and advantages of the present invention will become apparent after reading the accompanying description of a selected illustrative embodiment of the invention with reference to the attached drawing.

SUMMARY OF THE INVENTION

The foregoing objects of the present invention are achieved in gasification apparatus of dual-stacked, double-shell configuration in which high temperature downdraft gasification is carried out by pulling reaction air (or an air-steam mixture) into the apparatus at the oxidation reaction zone developed within the apparatus and thereafter leading and pulling the reacting and reacted gases generated within the apparatus downwardly through a materials reduction reaction zone with the material undergoing gasification and thence through a funnel shaped constricting hearth at relative high velocity to a gas velocity reduction zone. The double-shell apparatus then directs the reacted producer gas in counter-current indirect heat exchange flow relationship with the materials undergoing oxidation and reduction by passage of such gas within the annular space defined by the lower double-shell elements. The producer gas being pulled through the apparatus leaves the lower double-shell annulus proximate the upper boundary of the oxidation zone, is subjected to particulate matter disentrainment and then led into the upper portion of the annular space formed by the upper double-shell elements. The producer gas is pulled downwardly within such space in co-current indirect heat exchange flow relationship with the solid fuel materials undergoing drying and distillation within the upper double-shell elements of the apparatus. The producer gas leaves the upper double-shell annulus proximate the lower boundary of the distillation zone, is subjected to further cleaning and cooling and is then pulled through a suctionblower or other device creating the pulling action on all air and gaseous mixtures entering and being generated within the gasifier and passing through the system. The dual-stacked, double-shell construction of the gasifier apparatus comprises suspension or hanging of the inner shell elements within the outer shell elements to allow expansion of the gasifier double-shell without harmful stress buildup in the apparatus during its high temperature gasification operation.

DESCRIPTION OF THE DRAWING

The invention will be more clearly understood by reference to the following detailed description of an exemplary embodiment thereof in conjunction with the accompanying drawing in which the FIGURE is a side sectional elevation of gasifier apparatus for converting solid organic materials (having a fuel value) by high temperature conversion into clean-burning and uniform producer gas.

DETAILED DESCRIPTION OF THE INVENTION

Referring now in detail to a preferred embodiment illustrating the present invention, numeral 10 denotes generally the stationary gasifier reactor shown in the drawing. The reactor 10 is of two-part, double-shell construction. The inner shell is comprised of an upper tubular section 11 and a lower tubular section 12 which cooperate to form the supporting stack structure for developing and confining a downwardly moving column of feed material to be gasified. The outer shell surrounds and is spaced from the inner shell and is comprised of an upper tubular section 13, of greater diameter than inner section 11, and a lower tubular section 14, of greater diameter than the inner section 12, the shell sections forming therebetween annular spaces 15 and 16. Appropriate flanges are provided at the ends of tubular sections 11, 12, 13 and 14 of the gasifier 10 for sealably connecting and arranging same in accordance with the present invention. The double-shell structure of the gasifier is connected to, and supported by, a tubular base section 17 which includes a bottom wall 18 and a side access port 19 with removable cover 20.

In structural arrangement the outer-lower tubular section 14 of the gasifier is affixed through lower flange **14*a* to the upper flange 17*a* of the base section 17. The upper flange 14*b* of lower section 14 supports and is affixed to upper flange 12*a* of inner-lower tubular section 12. Thus, the inner section 12 hangs freely within outer section 14 and the two sections together form annular space 16. The inner-lower tubular section 12 of the gasifier contains the lower portion of the downwardly moving column of materials undergoing gasification, such column portion comprising the highest temperature reaction zones of oxidation and reduction. By provision of the suspended or hanging arrangement for the inner-lower tubular section 12, full expansion of such section is permitted under the high heat conditions experienced by the section without any build-up of stress in the outer (and supporting) tubular section 14. The annular space 16 defined by tubular sections 12 and 14 is open at the bottom so that the gases generated within gasifier 10, and moving downwardly therein, may enter such space through annular orifice 21 and move upwardly between the double-shell sections 12 and 14**.

The upper portion of the double-shell gasifier 10 is supported on and connected to, flanges **14*b* and 12*a* of the lower sections of the gasifier. Thus, lower flange 13*a* of outer tubular section 13 is affixed to flanges 14*b* and 12*a*. An upper flange 13*b* on section 13 supports inner tubular section 11 through its upper flange 11*a* and such inner section hangs freely within outer section 13 with these two sections together forming annular space 15. A spacing ring 22 is affixed to inner tubular section 11 at its lower end for sliding engagement with the inner wall of tubular section 13 whereby annular space 15 is effectively sealed from communication with the internal gasifier reaction space defined by inner reactor sections 11 and 12. Although the temperature conditions of the drying and distillation zones maintained within upper tubular section 11 are not as severe as the temperatures within the lower oxidation and reduction zones (established within lower tubular section 12), the suspended or hanging arrangement for upper section 11 allows for differential expansion between such section and its outer supporting tubular section 13**.

The lower end of inner tubular section 12 is closed by end wall **12*b* except for a central opening 12*c*. End wall 12*b* supports internally a funnel-shaped transition piece 23 which in turn supports at its upper periphery a grate member 24 which extends fully across the cross-sectional area of tubular section 12. The downwardly and inwardly tapering surface 23*a* of transition piece 23 cooperates with opening 12*c* of end wall 12*b* to form a throatlike constriction which causes a localized increase in the velocity of the gases passing through and leaving the reduction zone developed immediately above the grate 24**.

The upper end of the gasifier 10 is closed by plate 25 which has a central opening 25*a* through which the solid feed materials to be gasified are fed. Supported by the plate 25, and communicating with opening 25*a*, is a rotary valve or star feeder device 26 which seals off the upper end of the gasifier from atmosphere and which receives solid feed materials from feed hopper 27 located below the upper material discharge end of belt-type materials conveying device 28 of well-known design. As illustrated, the conveying device 28 is located within a housing or shroud 29. Solid material level sensing devices $S_1$ and $S_2$, of common type, are located along the inside wall of inner tubular section 11 near its upper end. These sensing devices control motor driven rotary valve 26 and the materials conveying device 28 in known manner and sequence whereby the solid materials level within the gasifier 10 ranges between angle-of-repose level $L_1$ (lowest level) and angle-of-repose level $L_2$ (highest level).

Air (or an air-steam mixture) enters the gasifier 10 within the oxidation (or hearth) zone (developed within the upper portion of lower tubular section 12) through inlet pipe 30 which includes a one-way, flapper-type valve $V_1$. The air (or air-steam) stream is deflected downwardly and outwardly throughout the materials column within the oxidation zone by deflector cone 31. Air and/or steam that may collect within the gasifier space between rotary valve 26 and the top of the materials column may be collected by several collector pipes 32 which open into such space in an area 33 which is protected from solid feed materials by depending feed skirt 34 leading from opening 25*a* in the cover 25. The collector pipes 32 communicate with down pipe 35 which terminates in an air/steam distribution cone 36 within the oxidation zone.

The producer gas generated during operation of the gasifier 10 (as described hereinafter) travels downwardly and leaves the lower reduction zone of the gasifier through grate 24 and opening 12*c* of the end wall 12*b* of lower tubular section 12 and then flows upwardly through the annular space 16 formed between lower section 12 and outer tubular section 14. Such gas leaves space 16 through a multiplicity of spaced, radially-projecting pipes 37 which lead the gas into an annular header 38. From header 38 the producer gas is led through pipe 39 into a hot gas, cyclone-type cleaner 40 of well-known construction and operation. The clean hot producer gas stream is thereafter led through pipe 41 to annular header 42 at the top of the gasifier and thence distributed to the top of annular space 15 (formed between upper tubular section 11 and outer tubular section 13) through a multiplicity of spaced, radially-projecting pipes 43. The gas stream then flows downwardly through annular space 15 until it leaves same through a multiplicity of spaced, radially-projecting pipes 44 which lead the gas stream into an annular header 45. From header 45 the producer gas is led through pipe 46 into a gas cooler-cleaner 47 of well-known construction and operation. Finally, the clean, relatively cool producer gas stream is led from the cooler-cleaner 47 through pipe 48 to a suction-blower 49 from which it is discharged through blower outlet 50 to line 51 for use as: a clean-burning gaseous fuel which can be directly substituted for natural gas, propane or fuel oil in boilers, dryers, kilns, furnaces, etc.; or a fuel for diesel or gasoline engines. The suction-blower 49 pulls all gases and gas mixtures through the entire system and the components of apparatus comprising the system as will be described hereinafter.

Ash particles, which remain as a solid residual of the solid fuel after the latters final high temperature reduction in the lower reaction zone of the gasifier, leave the reduction zone with the producer gas through opening 12*c* in end wall 12*b* and, for the most part, collect in the ash pit 52 defined by gasifier base section 17. Any entrained ash particles carried by the producer gas stream through annular space 16, pipes 37, header 38 and pipe 39 into the cyclone-type gas cleaner 40 are separated from the gas stream therein and drop to the bottom of the cleaner and exit same through pipe 53, three-way valve $V_2$ and pipe 54 for deposit in ash collector 55. Periodically the accululation of ash particles in collector 55 is removed by closing valve $V_2$ to pipe 53 (opening pipe 54 to atmosphere through line 56) and opening valve $V_3$ in ash exit line 57.

Water and tar removed from the producer gas as it passes through cooler-cleaner 47 drop to the bottom of the cooler-cleaner and exit same through pipe 58, three-way valve $V_4$ and pipe 59 for collection in trap 60. Periodically the accumulation of water and tar in trap 60 is removed by closing valve $V_4$ to pipe 58 (opening pipe 59 to atmosphere through line 61) and opening valve $V_5$ in drain line 62.

A series of sight holes or sight tubes 63 may be provided through the lower gasifier sections 12 and 14 wherein the high temperature oxidation and reduction zones are developed so that visual inspection can be made of such zones during operation of the gasifier and through which optical pyrometer readings may be taken to measure the temperature profile of these zones. Other temperature measuring devices (not shown) such as thermocouples, etc., may be located within the gasifier at critical points so that temperatures may be periodically or continuously observed, monitored and recorded for gasifier process control purposes.

Since the temperatures developed in the drying and distillation zones of the gasifier (within the upper gasifier section defined by inner tubular section 11) are substantially lower than developed in the lower oxidation and reduction zones, the build-up of a stress relationship between inner tubular section 11 and outer tubular section 13 is minimized because of the balancing heating effects on the outer section 13 of the hot producer gas stream flowing downwardly within annular space 15. Therefore, a hanging or suspended arrangement for inner tubular section 11 may not be required for all gasifiers constructed in accordance with this invention and the lower end of tubular section 11 may be fixedly attached to the lower periphery of outer tubular section 13.

The materials utilized for construction of the two-section, stacked double-shell gasifier reactor of the present invention must be carefully selected so as to withstand the extremely high temperatures developed during solid fuel gasification, particularly in the lower reactor section defining the oxidation and reduction zones. Thus, the inner-lower tubular section 12 of the gasifier and grate 24 must be constructed of high temperature nickel-steel alloy materials. Further, the funnel-shaped transition piece 23 which is supported within the lower portion of tubular section 12 is preferably formed of castable alumina ceramic material capable of withstanding temperatures of at least 1,600° C.

In further illustration of the gasifier apparatus of the present invention, a general description is now provided of the numerous reactions occurring between the solid fuels entering and passing through the gasifier and the air or air-steam stream introduced to the oxidation zone developed within the gasifier to generate the desired producer gas product fuel. Solid fuels of the types indicated hereinbefore are maintained within the gasifier 10 as a continuous downwardly moving column or stack extending from the top of the gasifier (below star feeder 26) to grate 24. In the upper double-shell section of the gasifier a top fuel drying zone is developed by heat rising within the fuel column and by heat transferred to the fuel therein through inner tubular section 11 from hot gases passing through annular space 15. For fuels such as wood wastes (having moisture levels of as high as 30% by weight) the drying reaction results in the production steam which may be removed from the top of the drying zone or transported to the oxidation zone as process steam (as via pipe 35 in the drawing). Temperatures at the top of drying zone may range from 100°–150° C. or more.

Still within the upper double-shell section of the gasifier, but below the drying zone, there is developed a fuel distillation or degasification zone within which low temperature carbonization occurs. Where wood wastes comprise the solid fuel, tars and oils are driven from the fuel within the distillation zone and the fuel is converted to charcoal. The heat for distillation obtains by radiation from the lower fuel oxidation (burning) zone and by heat transferred through inner tubular section 11 from hot gases passing through annular space 15. The vapors of distillation and steam are drawn downwardly within the downwardly moving fuel stack by suction-blower 49 which pulls all vapors and gases within the system to it.

In the lower double-shell section of the gasifier upper oxidation or burning and lower reduction zones are developed within the fuel column. Reaction air (or an air-steam mixture) is drawn into the fuel oxidation zone through line 30 by suction-blower 49. Within the oxidation or burning zone the fuel (if wood waste is now in the form of charcoal) is converted to hot gas (carbon dioxide-$CO_2$) and glowing carbon. Steam in the carbonization gases, and as may be introduced to the oxidation zone from outside of the gasifier, is partially dissociated into hydrogen and oxygen. Tar and oil components are dissociated. The dissociated oxygen burns with the charcoal and the hydrogen remains in the gases being drawn downwardly. The burning reaction between the oxygen in the air and from steam dissociation and the carbon in the fuel supplies sufficient heat for a second reaction to occur in the lowest portion of the stack or fuel column (passing through the reduction zone). This second reaction produces carbon monoxide (CO), a major combustible component of producer gas. Thus, the principal reactions that occur in the oxidation and reduction zones are:

$$C+O_2 \rightarrow CO_2$$

$$C+\tfrac{1}{2}O_2 \rightarrow CO$$

$$C+H_2O \rightarrow CO+H_2$$

$$CO+H_2O \rightarrow CO_2+H_2$$

$$CO_2+C \rightarrow 2CO$$

The tars and oils, principally produced within the distillation zone, are vaporized and move downwardly with the gases, and are decomposed within the oxidation and reduction zones by the hot glowing carbon into gases which include hydrogen and a small quantity of methane. Because of the high temperature operation possible with the gasifier design of this invention, the glowing carbon in the lower reduction reaction zone is substantially all converted to gaseous fuel form with only negligible quantities of unreacted carbon and the fuel ash (less than about 2% total) remaining as residue passing with the reaction gases through the grate 24 and funnel-shaped transition piece 23 into gas velocity reducing zone 52 wherein residual carbon and ash particles are, for the most part, disentrained. Thus, zone 52 acts as an ash pit or ash collection zone for the gasifier 10.

Having passed through the grate and funnel-shaped transition piece and through the ash disentrainment zone, the hot producer gas (500°–1,000° C.) moves upwardly through annular space 16 surrounding the reduction and oxidation zones and exits such space through pipes 37 for passage through header 38 and pipe 39 to a hot gas cyclone cleaner wherein fine carbon dust and ash particles are removed. The hot, clean producer gas leaving the cyclone (300°–500° C.) is returned to the upper end of annular space 15 for passage downwardly therethrough in co-current flow, indirect heat exchange relationship with the upper portion of the fuel column passing through the drying and distillation zones of the gasifier defined by the upper double-shell structure. By the time the gas stream has left annular space 15 (at the lower end thereof) it is reduced in temperature to 150°–300° C.

Within the gasifier the drying zone temperatures range from 150°–200° C., distillation zone temperatures range from 300° to 600° C. and the oxidation or burning zone temperatures are maintained at least above 700°–900° C. In the reduction zone temperatures of 1,000°–1,200° C. or more may be experienced. The producer gas, formed through operation of the apparatus of this invention from solid fuels of the type mentioned, is basically comprised of combustible and non-combustible gaseous components as follows with representative percentages (by volume) for these components indicated for several solid fuels:

| Producer Gas Component | Wood (25% Moisture) | Peat |
|---|---|---|
| Combustible Components | | |
| Carbon Monoxide (CO) | 23% | 19% |
| Hydrogen ($H_2$) | 14 | 11 |
| Methane ($CH_4$) | 1 | 1 |
| Non-Combustible Components | | |
| Carbon Dioxide ($CO_2$) | 16 | 14 |
| Nitrogen ($N_2$) | 46 | 55 |
| | 100% | 100% |

Producer gas obtained through operation of the apparatus of this invention, utilizing solid fuels such as peat, lignite, coal, anthracite, coke and other solid organic materials (including solid organic waste materials such as wood chips, sawdust, pine cones, other forest wastes, walnut and almond shells, fruit pits, corn cobs and other agricultural wastes, and like materials) may have heating values of 125–200 Btu/ft.$^3$.

There has thus been described apparatus in which it is feasible to gasify economically solid fuels, including a wide variety of organic waste materials, to form a clean-burning and uniform gaseous fuel (of low but effective heating value). It is obvious that one skilled in the art may make modifications in the details of construction of the apparatus described without departing from the spirit of the invention which is set out in varying scope in the appended claims.

What is claimed is:

1. Apparatus for effecting the high temperature gasification of solid organic feed materials having a fuel value into clean-burning and uniform gaseous fuels comprising:

(a) a gasification reactor vessel having an upper double-shell section including an inner shell element and an outer shell element and a lower double-shell section including an inner shell element and an outer shell element, the inner and outer shell elements of each reactor vessel section being affixed to one another at their upper peripheries with said inner shell elements of each section hanging freely within said outer shell elements, a solid material inlet at the upper end of said upper section, and a gas outlet at the lower end of said lower section, said reactor vessel sections defining a sequence of reaction zones from the material inlet to the gas outlet including drying, distillation, oxidation and reduction zones and confining a centrally disposed downwardly moving column of said solid feed materials within said zones, and said upper and lower double-shell sections defining with their respective inner and outer shell elements an upper annular shell space and a lower annular shell space;

(b) means for charging solid organic feed materials through said material inlet to continuously supply a downwardly moving column of said materials in said reactor;

(c) gas-feed means for admitting an oxygen-rich gas into said reaction vessel proximate the oxidation zone thereof so as to promote and sustain combustion of the column of organic materials passing therethrough;

(d) means connecting the gas outlet at the lower end of said lower reactor section with the lower end of the annular shell space of said lower section;

(e) means connecting the upper end of the annular shell space of the lower reactor section with the upper end of the annular shell space of the upper reactor section; and (f) gas suction means in communication with the lower end of the annular shell space of the upper reactor section for sequentially drawing oxygen-rich gas into the reaction vessel through the gas-feed means, drawing reacting gases and vapors downwardly through the zones of the reactor vessel, and drawing gaseous fuel produced within said vessel outwardly through the gas outlet thence upwardly through the annular shell space of the lower reactor section in indirect counter-current heat exchange relationship with the materials column portion in the reduction and oxidation zones within said vessel thence through the means connecting the upper end of the lower annular shell space with the upper end of the upper annular shell space and thence downwardly through the annular shell space of the upper reaction section in indirect co-current heat exchange relationship with the materials column portion in the drying and distillation zones of said vessel.

2. Apparatus as defined in claim 1 in which the gas-feed means for admitting oxygen-rich gas into the oxidation zone of the reactor vessel comprises at least one gas inlet pipe in communication with the atmosphere.

3. Apparatus as defined in claim 2 in which each gas inlet pipe of the gas-feed means includes a one-way flapper-type valve which admits oxygen-rich gas when the gasification reactor vessel is subjected to a negative pressure by the gas suction means and which precludes any outflow of hot gases passing through said vessel.

4. Apparatus as defined in claim 1 in which a funnel-shaped transition piece is located within the lower portion of the lower double-shell section providing a throat-like constriction in said section leading to the gas outlet therein.

5. Apparatus as defined in claim 4 in which the funnel-shaped transition piece carries with it across its upper periphery a grate which supports the downwardly moving column of solid organic material within the gasification reactor vessel.

6. Apparatus as defined in claim 1 in which the means connecting the upper end of the annular shell space of the lower reactor section with the upper end of the annular shell space of the upper reactor section includes a hot-gas cyclone-type cleaner for removing carbon dust and ash particles from the gaseous fuel produced within the gasification reactor vessel.

7. Apparatus as defined in claim 1 in which means are provided for removing steam generated in the uppermost reaction zone of the gasification reactor vessel during drying of the organic feed materials passing therethrough and for passing said steam to the oxidation and reduction reaction zones within the lower double-shell section of said vessel for dissociation in said zones.

8. Apparatus as defined in claim 1 in which the means for charging solid organic feed materials through the material inlet of said gasification reactor vessel comprises a rotary feeder valve through which said materials are fed to continuously supply the downwardly moving materials column and by which said reactor vessel is effectively sealed from atmosphere.

* * * * *